US006901663B2

(12) United States Patent
Grieve

(10) Patent No.: US 6,901,663 B2
(45) Date of Patent: Jun. 7, 2005

(54) HAND-HELD TOOL FOR PIERCING AND SCRAPING

(76) Inventor: Thomas G. Grieve, 6520 Rico Rd., Wichita, KS (US) 67204

( * ) Notice: Subject to any disclaimer, the term of this patent is extended or adjusted under 35 U.S.C. 154(b) by 0 days.

(21) Appl. No.: 10/656,454

(22) Filed: Sep. 4, 2003

(65) Prior Publication Data

US 2005/0050733 A1 Mar. 10, 2005

(51) Int. Cl.[7] ..... B26B 29/02
(52) U.S. Cl. ..... 30/151; 30/125; 30/537
(58) Field of Search ..... 30/539–541, 125, 30/143, 504, 151, 169, 356

(56) References Cited

U.S. PATENT DOCUMENTS

| | | | | |
|---|---|---|---|---|
| 4,071,952 A | * | 2/1978 | Meshulam et al. | 30/151 |
| 4,617,735 A | * | 10/1986 | Silverstein | 30/151 |
| 5,014,434 A | * | 5/1991 | Skerker et al. | 30/345 |
| 5,431,283 A | | 7/1995 | Weinstein et al. | 206/531 |
| 5,722,563 A | | 3/1998 | Hunts | 221/25 |
| 5,853,101 A | | 12/1998 | Weinstein | 220/284 |
| 5,857,237 A | | 1/1999 | Dranginis | 15/236.02 |
| 5,896,667 A | | 4/1999 | Hawkins | 30/294 |
| 6,311,362 B1 | | 11/2001 | Arbogast | 15/236.08 |
| 6,557,740 B1 | | 5/2003 | Dent | 225/104 |

* cited by examiner

*Primary Examiner*—Douglas D Watts
(74) *Attorney, Agent, or Firm*—Jeffrey L. Thompson; Thompson & Thompson, P.A.

(57) ABSTRACT

A hand-held tool for piercing and scraping includes a handle with a short wedge-shaped blade having a pointed end for concentrating tearing forces for piercing, and a large radius tapering away from the pointed end for scraping. A thumb-rest portion is located a short distance from the handle to facilitate use of a thumb to grip and tear away packaging. The tool can also be used to scrape off sticky price labels or to clean grime, while minimizing scratching due to its plastic construction. A flexible cap can be slipped over the blade portion to protect and keep it clean. The cap can be removed and placed in the handle when using the tool, and easily removed again by pushing down on either end of the cap to raise the opposite end for grasping. The blade and handle can be injection molded as one piece from a high strength plastic.

25 Claims, 6 Drawing Sheets

HAND-HELD TOOL FOR PIERCING AND SCRAPING

BACKGROUND OF THE INVENTION

1. Field of the Invention

The present invention relates generally to hand-held tools for use in performing piercing and scraping functions. In particular, the present invention relates to a hand-held tool that can be used to pierce blister-type packages and sealed bottle caps, and that can also be used to scrape away labels and grime from surfaces.

2. Description of the Related Art

It is common in the pharmaceutical industry to package individual pills in blister-type packaging as an alternative to bottle-type bulk packaging. However, some individuals have difficulty opening such blister-type packages to remove the pills therefrom using only their fingers. These individuals often struggle with pushing their finger or thumbnails into the foil of the blister-type packages, or pressing the blister of the packaging until the pills themselves push through the foil. To solve this problem, such individuals often resort to using common household utensils, such as knives or other pointed objects, to aid in piercing the blister-type packages.

However, when knives are used to pierce through a blister-type package or bottle seal, the knife can be awkward and dangerous to handle. A metal knife can also leave scratch marks when using the knife as a scraper to remove adhesive labels, grime or other materials from a surface. Also, in order to maintain control of a knife being used for these purposes, the user is sometimes tempted to grasp the blade of the knife to reduce the distance to the work being performed. While this does increase the control of the knife blade while trying to open or scrape something, it is also more dangerous.

Thumbnails are also sometimes employed to accomplish piercing and scraping tasks with varying degrees of success. Depending on the nature of the work or how much such work is done, this can be quite abusive to the thumbnail.

Therefore, it can be appreciated that there exists a need for an improved hand-held tool for performing piercing and scraping functions while maintaining precise control, to avoid having to use a knife or thumbnail.

SUMMARY OF THE INVENTION

It is an object of the present invention to provide an improved hand-held tool for piercing and scraping that solves the problems described above and the other disadvantages inherent in using a knife or thumbnail to perform piercing and scraping functions.

It is a further object to provide a hand-held tool for piercing and scraping that is economical to manufacture, effective for a wide variety of intended uses, efficient and durable in use, capable of a long operating life, and particularly well suited for use in removing articles, such as pills, from blister-type packaging.

In order to realize the objects and advantages set forth above, the Applicant has developed a unique hand-held tool that can both safely and easily pierce sealed bottle caps on bottles and individually packaged pills on a sheet of blister-type packaging, and that can be used to rub off sticky price labels on gifts or clean a surface by scraping grime while minimizing scratching. After piercing a package, a user's thumb can be used to grip the torn paper and/or foil packaging against a flat area of the blade and pull off the seal. The pointed or curved area of the tip can be used as required to rub or scrape.

The hand-held tool of the present invention provides a convenient and safe way for senior citizens and others who have difficulty opening blister-type packaging to do so. The tool can also be used for removal by scraping away price labels on gifts and other cleaning uses, while minimizing scratching due to the tool being molded of plastic material.

The tool is small enough to fit comfortably in the palm of a person's hand and can be stored in a purse, on a hook on the wall, or in a desk drawer. A removable protective cap that can be stored in the handle is also provided. The tool has a slightly raised, flat surface that creates a bordered area onto which an advertising logo can be imprinted. The cost of the device is low enough to be given away as a promotional product or sold at retail.

According to a broad aspect of the present invention, a hand-held tool is provided for piercing and scraping, comprising: a handle; a wedge-shaped blade protruding from the handle, the blade having a pointed end for piercing and an edge for scraping; and a removable flexible cap that fits over the wedge-shaped blade to protect and keep the blade clean.

According to another broad aspect of the present invention, a hand-held tool is provided, comprising a handle, a blade, and a removable flexible cap for covering and protecting the blade. The handle has a hollow body with a generally rectangular block-shaped configuration with front and rear ends, top and bottom sides, and left and right sides. The bottom side is substantially open to reveal an interior space of the hollow body. The handle is sized to fit comfortably within a user's hand. The blade protrudes from the front end of the handle and has a rounded portion adjacent to the front end of the handle, a flat thumb-rest portion protruding from the rounded portion, a scraper edge extending along at least a portion of an outer periphery of the flat thumb-rest portion, and a pointed end formed at a front tip of the blade. The thumb-rest portion is arranged such that a user's thumb can be pressed against it to grip and tear away packaging after piercing with the pointed end of the blade. The blade is shorter in length than the handle. The cap has an inner dimension that allows the cap to fit snugly over the rounded portion of the blade, and an outer dimension that allows the cap to fit snugly within the interior space of the hollow body.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

Figure 1:
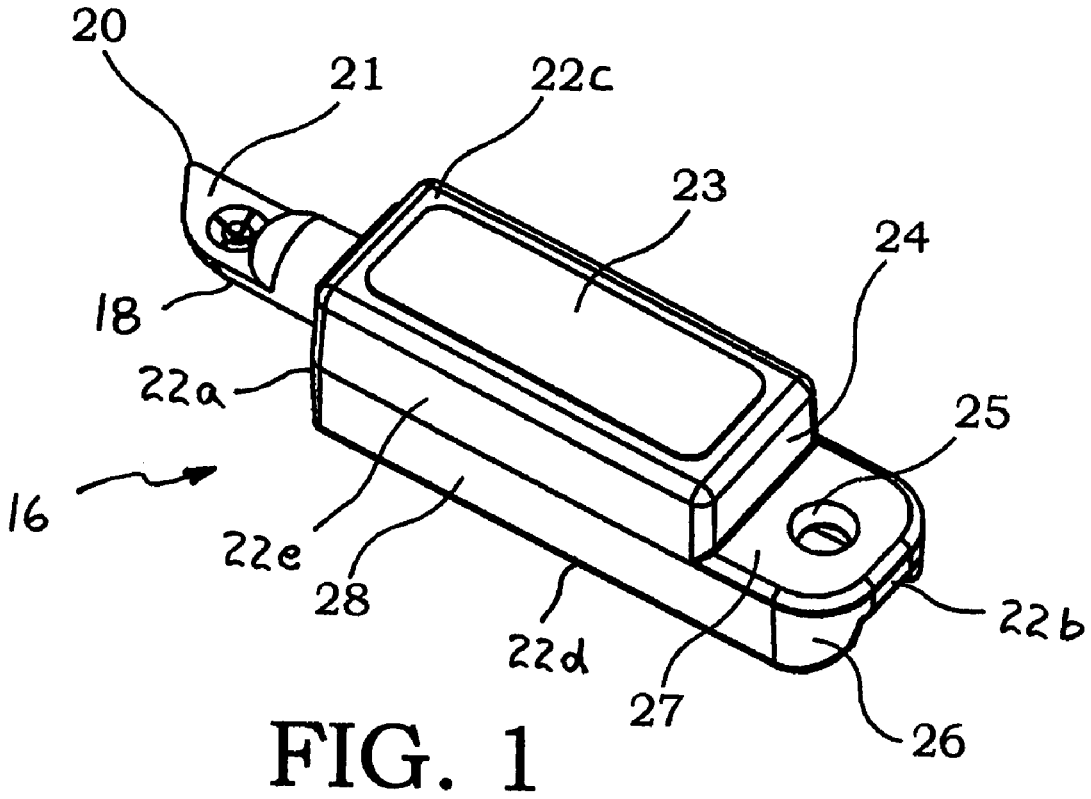
FIG. 1 is a top perspective view of a hand-held tool for piercing and scraping according to the present invention.
Figure 2:
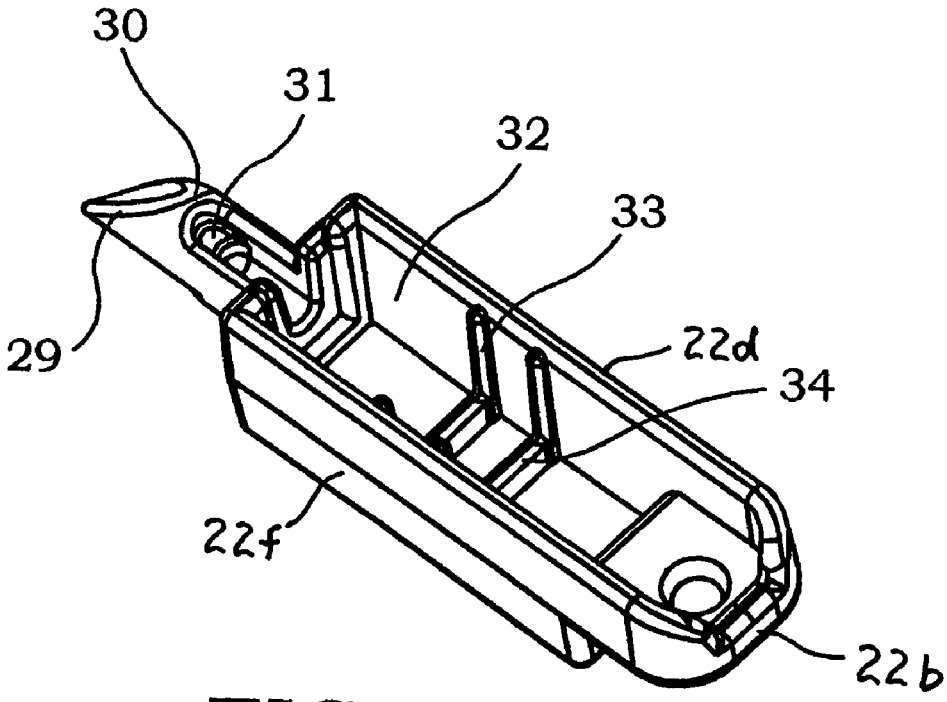
FIG. 2 is a bottom perspective view of the tool shown in FIG. 1.

A hand-held tool 16 for piercing and scraping according to a preferred embodiment of the present invention will now be described with reference to FIGS. 1 to 12 of the accompanying drawings.

The hand-held tool 16 according to the present invention and method of using the same will first be described with reference to FIGS. 1 to 6. The tool 16 has a handle 28 and a wedge-shaped blade 18 protruding from the handle 28. The blade 18 has a pointed end 20 with a small radius of approximately 0.03 inch for concentrating tearing forces for piercing blister-type packaging, plastic bags, sealed caps on containers, and other similar tasks. The pointed end 20 is also suitable for cleaning grime from corners, such as on sink faucets, window corners, and other areas that require a small scraping tool. The tool 16 is preferably molded from a tough plastic, such as polycarbonate, for lasting durability when used appropriately.

The handle 28 comprises a hollow body having a generally rectangular block-shaped configuration with front and rear ends 22*a*, 22*b*, top and bottom sides 22*c*, 22*d*, and left and right sides 22*e*, 22*f*. The bottom side 22*d* of the handle is substantially open to reveal an interior space 32 of the hollow body. The handle 28 is sized to fit comfortably within a user's hand.

The blade 18 has a rounded portion 43 adjacent to the front end 22*a* of the handle 28, and a flat thumb-rest portion 21 protruding forwardly from the rounded portion 43. A scraper edge 40 extends along an outer periphery of the flat thumb-rest portion 21. The pointed end 20 of the blade 18 is formed at a front tip of the blade 18. The thumb-rest portion 21 is arranged such that a user's thumb can be conveniently pressed against the thumb-rest portion 21, while the handle 28 is held in the palm of the user's hand, to grip and tear away packaging after piercing with the pointed end 20 of the blade 18. The blade 18 is shorter in its overall length than the handle 28.

The scraping edge 40 comprises a generally straight first portion 40*a* adjacent to the rounded portion 43. The first portion 40*a* extends approximately parallel to a longitudinal axis of the handle 28. The scraping edge 40 also has an arcuate second portion 40*b* adjacent to the first portion 40*a*, and a generally straight third portion 40*c* extending between the arcuate second portion 40*b* and the pointed end 20. The third portion 40*c* extends at an obtuse angle of approximately 120 degrees relative to the first portion 40*a* of the scraping edge 40. The arcuate second portion 40*b* of the scraping edge 40 provides a continuous transition from the first portion 40*a* to the third portion 40*c*.

Figure 9:
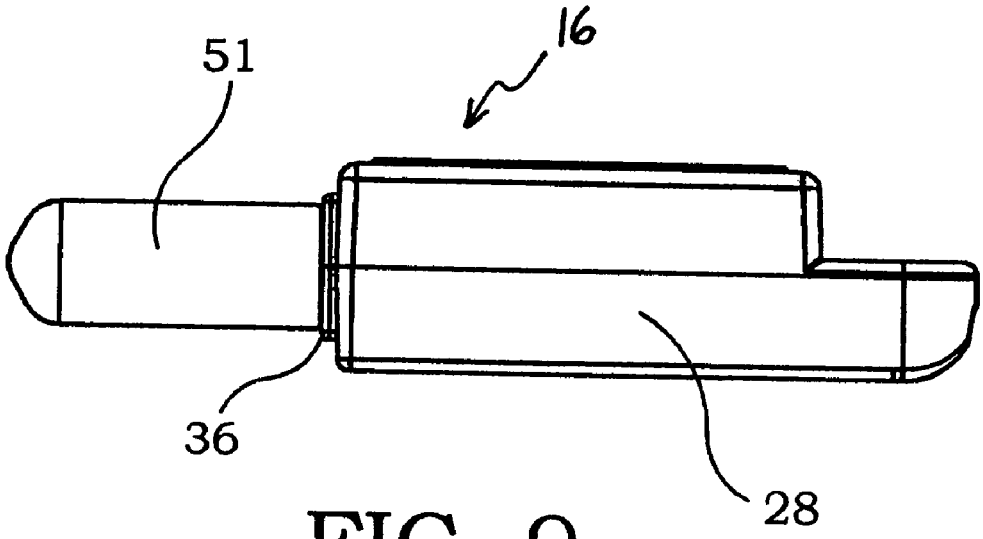
FIG. 9 is a side view showing the tool with a protective cap installed over the blade.
Figure 10:
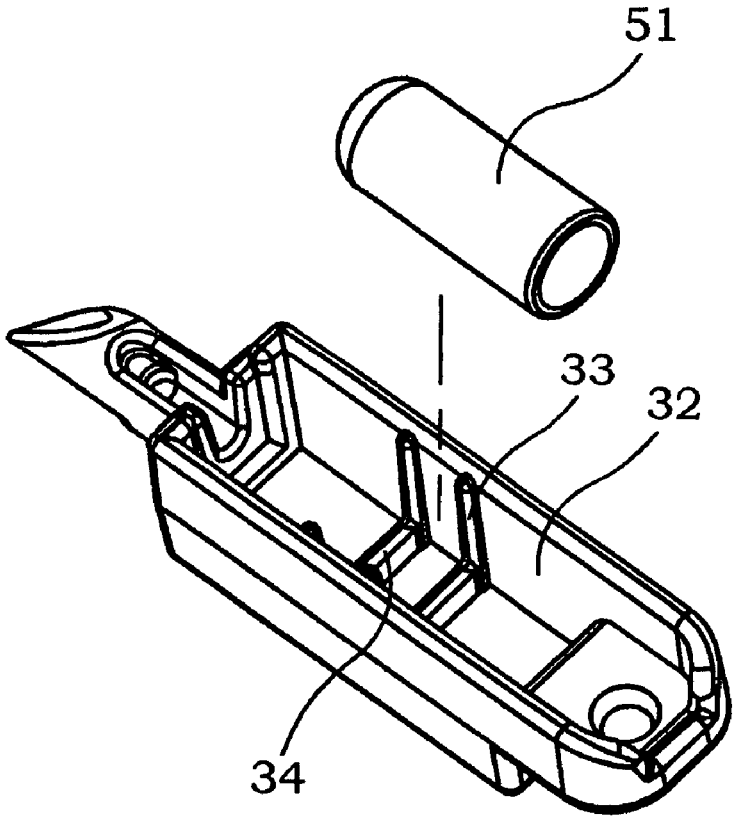
FIG. 10 is an exploded bottom perspective view showing the tool of the present invention with its protective cap.

A removable flexible cap 51, shown in FIGS. 9 and 10, fits over the blade 18 to protect and keep the blade 18 clean. The cap 51 has an inner dimension that fits snugly over the rounded portion 43 of the blade 18. The cap 51 has an outer dimension that fits snugly within the interior space 32 of the hollow body of the handle 28.

Figure 3:
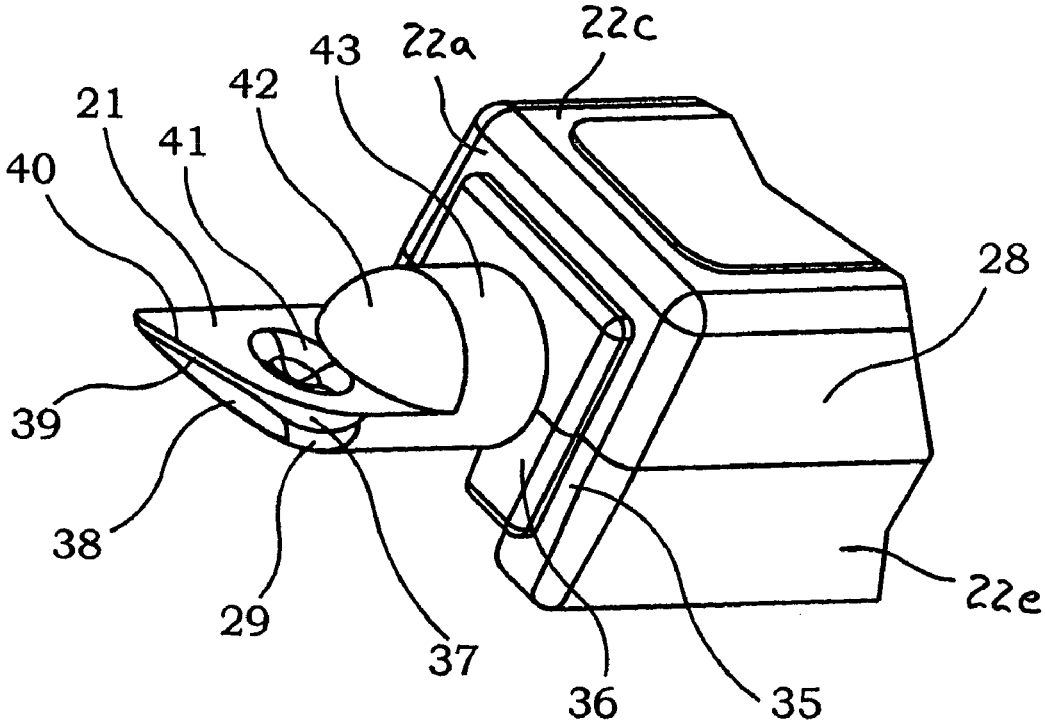
FIG. 3 is an enlarged fragmentary perspective view of a blade of the tool shown in FIG. 1.
Figure 4:
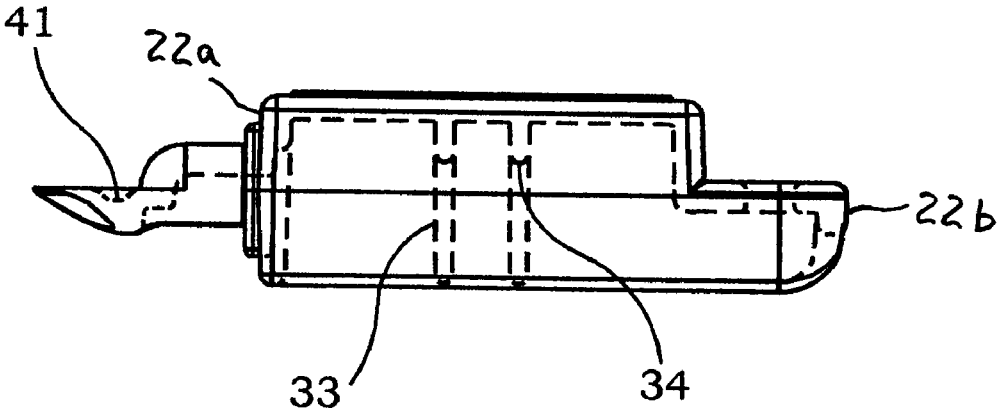
FIG. 4 is a side view of the tool with dashed lines showing centrally located ribs.
Figure 5:
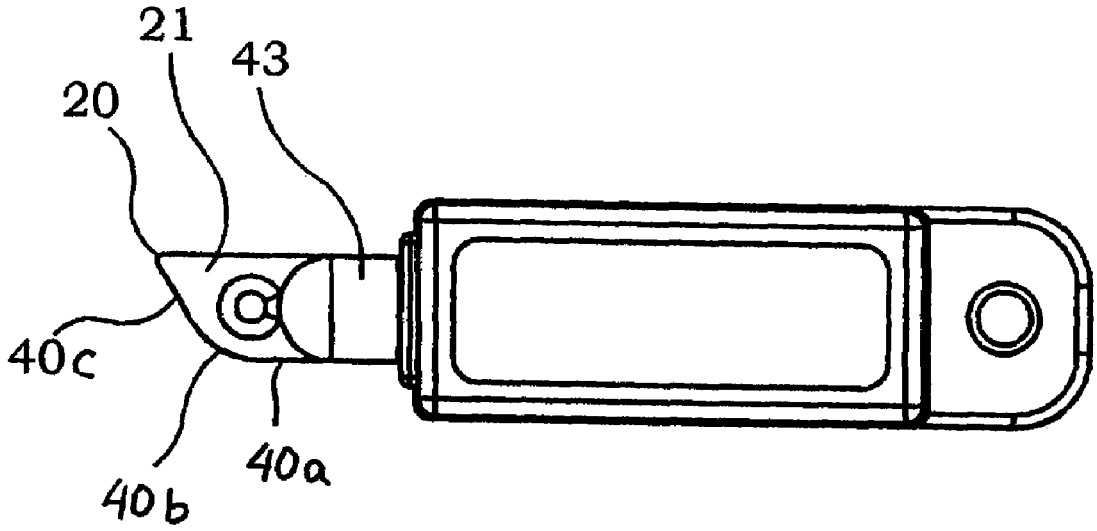
FIG. 5 is a top plan view of the tool showing, among other things, an area for displaying a logo.
Figure 6:
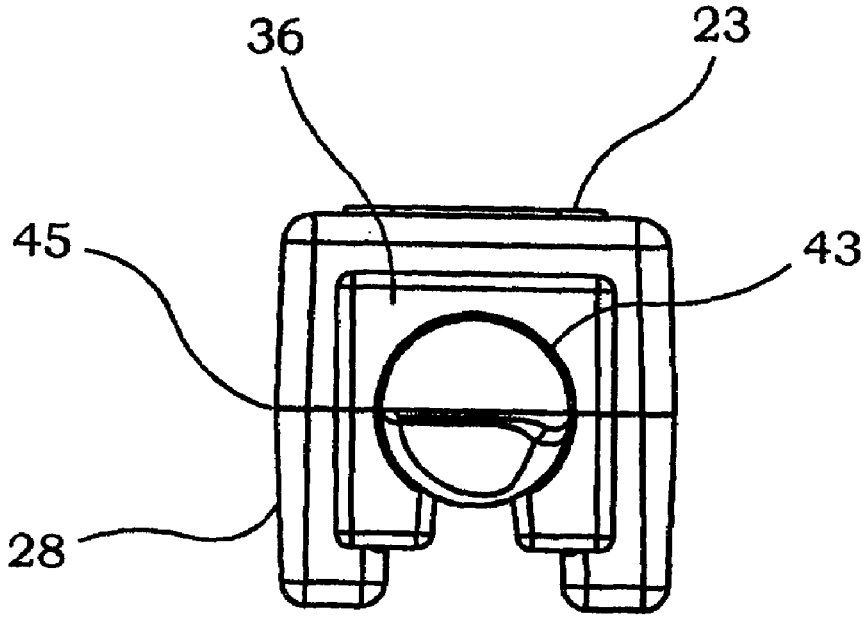
FIG. 6 is an enlarged front end view of the tool according to the present invention.

To increase the durability of the tool 16, the third portion 40*c* of the scraping edge 40 is bordered on a side opposite from the thumb-rest portion 21 by a flat edge 39 (see FIG. 3). The flat edge 39 is approximately 0.02 inch thick and also is angled back slightly (i.e., about 15 degrees) from perpendicular to the flat area of the thumb-rest portion 21. The flat edge 39 is angled back to allow the scraping edge 40 to be somewhat sharper and to prevent the scraping edge 40 from being tipped up from a surface during scraping, as would be the case if the flat edge 39 was not angled back. Thus, the tool 16 when used for scraping can be rocked back 15 degrees from perpendicular to the work before the vertex created between the flat edge 39 and the wedge 38 contacts the work and rocks the scraping edge 40 up slightly. This would reduce the effectiveness of the scraping action and is the primary reason the flat edge 39 is angled back.

The thumb-rest portion 21 is positioned a short distance from the handle 28 to allow precise control, as compared to what a longer blade would offer, and to enable a person's thumb to clamp down on the flat area of the thumb-rest portion 21. The ability to hold the handle 28 in a person's hand and still have the thumb free to clamp down on frayed packaging after piercing with the pointed end 20 and tear it back to expose the contents is what makes the proximity of the thumb-rest portion 21 to the handle 28 so important.

The wedge 38 slopes back toward the handle 28 at an angle of about 55 degrees from perpendicular to the flat area of the thumb-rest portion 21 for easy piercing of packaging. The third portion 40*c* of the scraping edge 40 in the plan view of FIG. 5 angles back toward the handle 28 at an angle of approximately 30 degrees from parallel to the front boss area 36 that protrudes from the front of the handle 35 (i.e., the third portion 40*c* is angled 120 degrees from the first portion 40*a*). This provides a comfortable position holding the handle 28 when using edge 40 for scraping price labels from gifts, tape from windows, or other scraping tasks.

The arcuate second portion 40*b* of the scraping edge 40 has a relatively large radius (e.g., approximately 0.30 inch in the preferred embodiment). The arcuate second portion 40*b* blends the third portion 40*c* at the front of the scraping edge 40 into the first portion 40*a* at the rear thereof. The first portion 40*a* of the scraping edge 40 is disposed perpendicular to the front boss area 36. The large radius of the arcuate second portion 40*b* of the scraping edge 40 is well suited for the concentrated scraping required in some applications. The flat edge 37, which is formed on a back side of the arcuate second portion 40*b* of the cutting edge 40, sweeps from 0 degrees to 15 degrees to match the flat edge 39. A portion 29 having a variable radius blends the pointed end 20 with the wedge 38 and the rounded portion 43.

A shallow depression 41 is formed in the thumb-rest portion 21 of the blade 18. The shallow depression 41 aids in the removal of pills from a blister-type package by allowing a person's thumb to pin a pill in the shallow depression 41 and remove it from the blister-type package after piercing the package and tearing back the seal. The perimeter of the thumb-rest area 21 is left without a radius to allow the edges to remain sharp for tearing seals and bags after piercing, and so the edges are also sharp for scraping as required.

The rounded portion 43 has a generally cylindrical shape so that the protective cap 51, shown in FIGS. 9 and 10, can slip over the rounded portion 43 and remain in place due to the somewhat snug slip fit between them. The bottom 30 of the rounded portion 43 remains a full radius between the variable radius portion 29 and the required coring 31 to facilitate the protective cap 51 staying in place. The coring 31 is required so the injection molding process does not leave sink marks on the part, and the molding cycle time will also be reduced. A spherical portion 42 is provided between a front end of the rounded portion 43 and a rear end of the thumb-rest portion 21 to help keep the thumb-rest portion 21 from protruding too far into a package pierced by the pointed end 20 of the blade 18.

A logo area 23 is provided on the top side 22*c* of the handle 28. The logo area 23 is raised about 0.015 inch from the top side 22*c* of the handle 28 to give a nice border for printing an advertisement or other visual indicia on the tool 16. The back 24 of the top side 22*c* of the handle 28 also sets the logo area 23 apart from the hole 25 to help highlight the logo area 23. The hole 25, which is located in a lowered step at the rear area 27 of the handle 28, is suitable for hanging the tool 16 from a hook on a wall or from a key chain. The rear handle radii 26 serve to provide a comfortable feel when gripping the handle 28 of the tool 16 in a user's hand while using the present invention.

The interior space 32 allows the protective cap 51, shown in FIGS. 9 and 10, to be stored there when using the tool 16. A pair of centrally located centering ribs 33 protrude from each of the right and left sides of the hollow body of the handle 28 into the interior space 32 for squeezing and holding the cap 51 in place. A pair of cross ribs protrude from the top side of the hollow body of the handle 28 into the interior space 32. The centrally located ribs 33 taper approximately three degrees each as they extend toward the cross ribs 34. The progressive narrowing of the centrally located ribs 33 squeeze the protective cap 51 and hold it in place. The protective cap 51 lays flat on the cross ribs 34 when the cap 51 is fully inserted into the interior space 32.

The parting line 45 for the handle 28 is on the same plane as the flat area of the thumb-rest portion 21 in the preferred embodiment. Other parting lines could be incorporated into different embodiments of the present invention.

Figure 7:
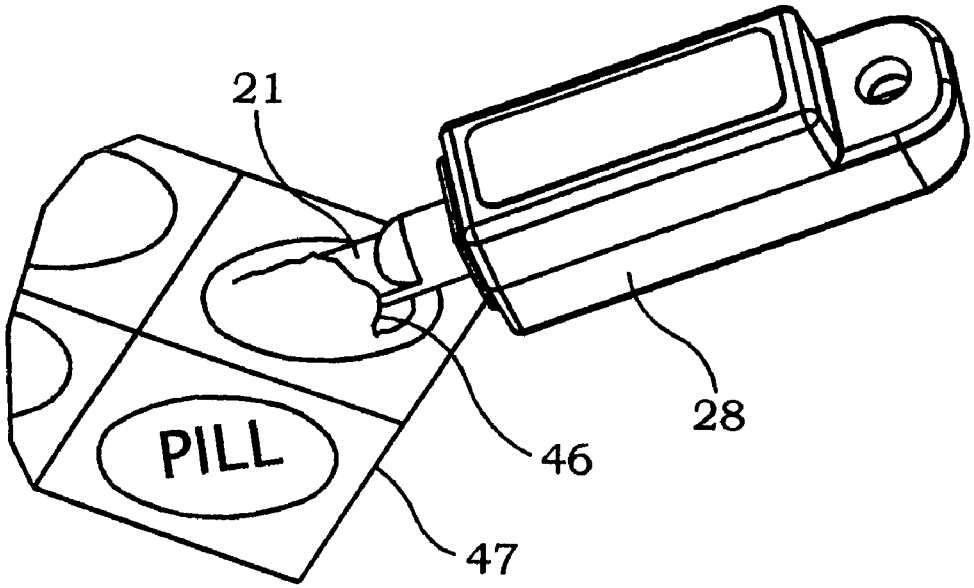
FIG. 7 is a top perspective view of the tool according to the present invention, showing the tool in use puncturing a blister pack to retrieve a pill therefrom.
Figure 8:
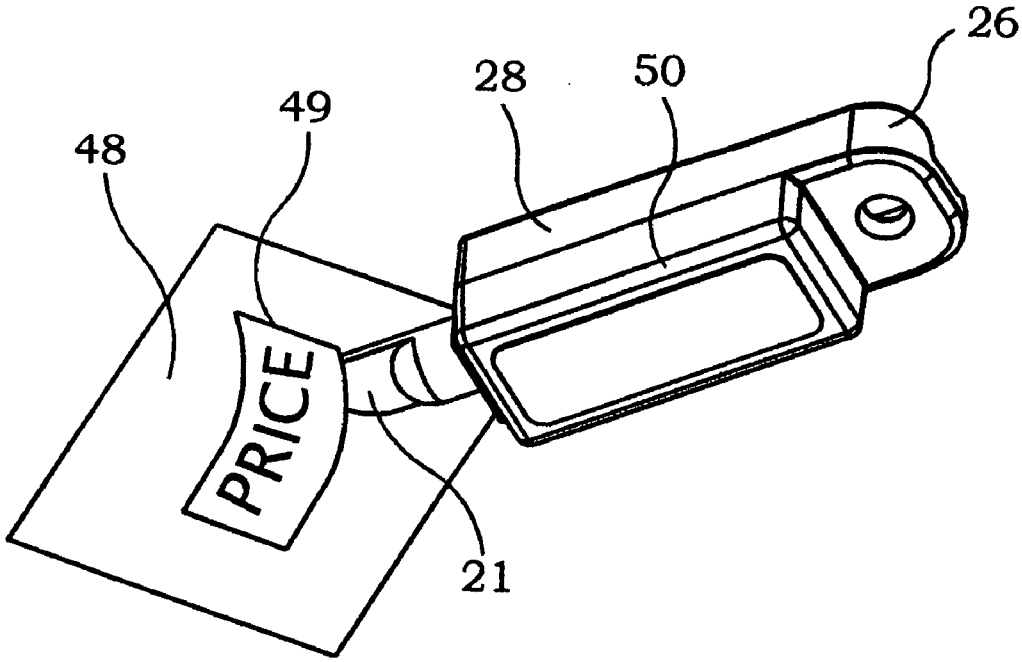
FIG. 8 is a side perspective view of the tool according to the present invention, showing the tool in use scraping off a sticky price label.

FIGS. 7 and 8 show the tool 16 of the present invention in actual use. In FIG. 7, the tool 16 has pierced a pill pack 47 and the frayed seal 46 is ready to be torn back by clamping on the frayed seal 46 with a person's thumb against the thumb-rest portion 21 and tearing it back while holding the handle 28 in the person's hand. In FIG. 8, the present invention is shown scraping a price label 49 off a gift 48. The perimeter of the thumb-rest portion 21 is being used to remove the price label 49. The contours of the thumb-rest portion 21 permit the handle 28 to be held at angles that allow easy viewing of the work area. The radii around the handle 50 make for a comfortable grip on the handle 28.

The use and storage of the protective cap 51 will now be described with reference to FIGS. 9 to 12. FIG. 9 shows the protective cap 51 installed over the rounded portion 43 of the blade 18 and butting up against the front boss area 36 of the handle 28. The protective cap 51 keeps the surfaces of the blade 18 clean when in a desk drawer or a purse, for example. The protective cap 51 also serves to keep the pointed end 20 from making a hole in a pocket or purse or in other places it may be stored. From a cosmetic point of view, a protective cap 51 having a different color than the rest of the tool 16 will enhance the overall appearance. The normal molding material for the present invention would be a transparent color of polycarbonate, and the protective cap 51 would normally be dip molded from an opaque PVC.

Figure 11:
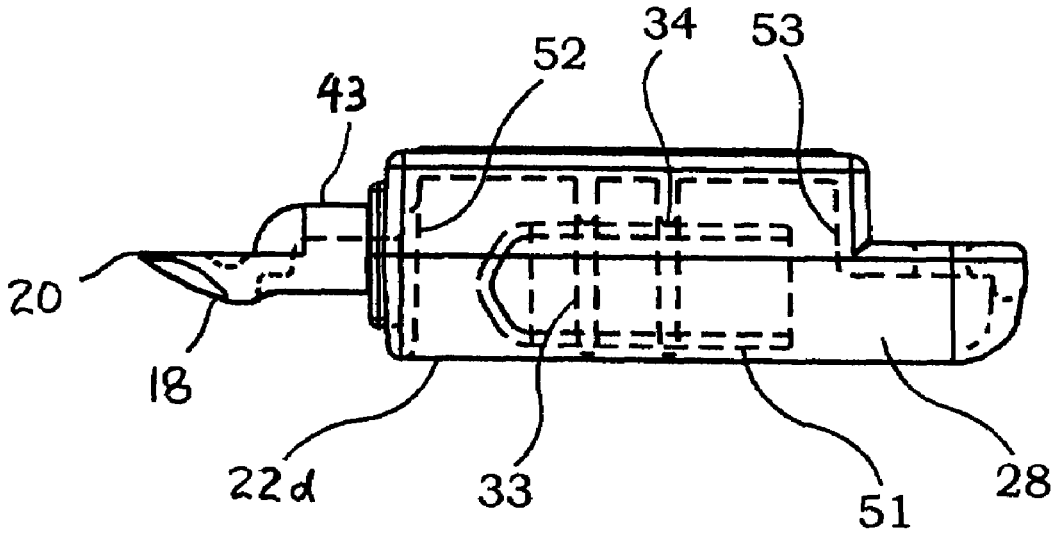
FIG. 11 is a side view of the tool with dashed lines showing the protective cap positioned within the handle.

FIG. 10 is an exploded view of the protective cap 51 over the interior space 32 that the protective cap 51 can be placed into. FIG. 11 shows the protective cap 51 installed in the interior space 32 of the handle 28 laying flat on the cross ribs 34. In this position, the flexible protective cap 51 is being squeezed slightly by the centrally located ribs 33 and is fully above the bottom side 22*d* of the handle 28. The front of the interior space 52 and the rear of the interior space 53 provide sufficient room for the protective cap 51. The size of the interior space 32 and the protective cap 51 are such that if the protective cap 51 is placed in the interior space 32 at the forward limit so that the protective cap 51 touches the front 52 of the interior space 32, the centrally located ribs 33 will still be able to squeeze the flexible protective cap 51 to hold it in place. The same is true if the protective cap 51 is placed in the interior space 32 at the rear limit so that the protective cap 51 touches the rear 53 of the interior space 32.

Figure 12:
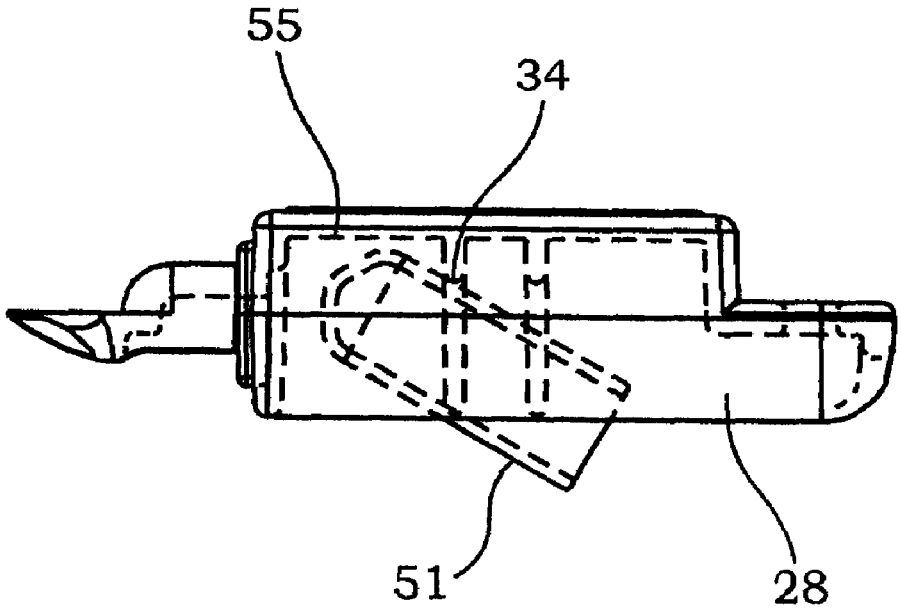
FIG. 12 is a side view of the tool with dashed lines showing the protective cap being pivoted in a teeter totter-type fashion within the handle.

FIG. 12 shows the protective cap 51 being pushed down toward the underside 55 of the top side 22*c* of the handle 28 prior to being removed. The cross ribs 34 each provide a fulcrum about which the protective cap 51 can be pivoted in a teeter totter fashion. The protective cap 51 can be pushed down and pivoted about the cross ribs 34 in a teeter totter fashion into either the forward or rear area of the underside 55 of the top side 22*c* of the handle 28. This would make the opposite end of the protective cap 51 raise up, thereby facilitating easy removal from the interior space 32. The protective cap 51 can be placed in the handle 28 with the rounded end thereof facing the forward or rear areas of the interior space 32.

The hand-held tool 16 described above provides a piercing and scraping device that can be used as an alternative to a person's thumbnail, particularly when certain tasks would impose stress and/or abrasion to the thumbnail, thereby saving the thumbnail from possible abuse.

While the invention has been specifically described in connection with specific embodiments thereof, it is to be understood that this is by way of illustration and not of limitation, and the scope of the appended claims should be construed as broadly as the prior art will permit.

What is claimed is:

1. A hand-held tool for piercing and scraping, comprising:

a handle;

a wedge-shaped blade protruding from the handle, said blade having a pointed end for piercing and an edge for scraping; and a removable flexible cap that fits over the wedge-shaped blade to protect and keep the blade clean;

wherein said handle comprises a hollow body with an interior space that receives and holds the cap when the blade is being used for piercing or scraping.

2. The hand-held tool according to claim 1, wherein said handle further comprises at least one rib protruding into said interior space for squeezing and holding the cap in place.

3. The hand-held tool according to claim 1, wherein said a hollow body comprises front and rear ends, top and bottom sides, and left and right sides, the bottom side being substantially open so that said an interior space of the hollow body can be used to receive and store the cap when the blade is being used.

4. The hand-held tool according to claim 3, further comprising a pair of centering ribs protruding from each of the right and left sides into the interior space of the hollow body for squeezing and holding the cap in place.

5. The hand-held tool according to claim 4, further comprising a pair of cross ribs protruding from the top side into the interior space of the hollow body, said cross ribs each providing a fulcrum about which the cap can be pivoted to raise an end thereof to facilitate removal of the cap from the interior space of the hollow body.

6. The hand-held tool according to claim 3, wherein said wedge-shaped blade protrudes from one of said front and rear ends of the hollow body.

7. The hand-held tool according to claim 1, wherein said wedge-shaped blade further comprises a substantially flat thumb-rest portion located between the pointed end and the handle, said thumb-rest portion being arranged such that a user's thumb can be conveniently pressed against the thumb-rest portion, when the handle is held in the palm of the user's hand, to grip and tear away packaging after piercing with the pointed end of the blade.

8. The hand-held tool according to claim 7, wherein said thumb-rest portion has a shallow depression formed therein for aiding in the removal of pills from a blister-type package.

9. The hand-held tool according to claim 1, wherein said handle has a length that fits comfortably within a user's hand, and said wedge-shaped blade is shorter in length than said handle.

10. The hand-held tool according to claim 1, wherein said edge for scraping comprises a generally straight first portion closest to the handle that extends approximately parallel to a longitudinal axis of the handle, an arcuate second portion adjacent to the first portion, and a generally straight third portion extending between the arcuate second portion and the pointed end.

11. A hand-held tool for piercing and scraping, comprising:

a handle;

a wedge-shaped blade protruding from the handle, said blade having a pointed end for piercing and an edge for scraping; and a removable flexible cap that fits over the wedge-shaped blade to protect and keep the blade clean;

wherein said edge for scraping comprises a generally straight first portion closest to the handle that extends approximately parallel to a longitudinal axis of the handle, an arcuate second portion adjacent to the first portion, and a generally straight third portion extending between the arcuate second portion and the pointed end; and wherein said third portion of the edge for scraping extends at an obtuse angle relative to said first portion of the edge, and said arcuate second portion of the edge provides a continuous transition from the first portion to the third portion.

12. A hand-held tool for piercing and scraping, comprising:

a handle;

a wedge-shaped blade protruding from the handle, said blade having a pointed end for piercing and an edge for scraping; and a removable flexible cap that fits over the wedge-shaped blade to protect and keep the blade clean;

wherein said blade comprises a rounded portion disposed between said handle and said edge, said rounded portion providing a surface for receiving said cap over said blade with a snug slip fit therebetween.

13. The hand-held tool according to claim 1, wherein said handle has a lowered step at a rear end thereof, and a hole extending through said lowered step for hanging the tool.

14. A hand-held tool, comprising:

a handle comprising a hollow body having a generally rectangular block-shaped configuration with front and rear ends, top and bottom sides, and left and right sides, the bottom side being substantially open to reveal an interior space of the hollow body, said handle being sized to fit comfortably within a user's hand;

a blade protruding from the front end of the handle, said blade having a rounded portion adjacent to the front end of the handle, a flat thumb-rest portion protruding from the rounded portion, a scraper edge extending along at least a portion of an outer periphery of the flat thumb-rest portion, and a pointed end formed at a front tip of the blade, said thumb-rest portion being arranged such that a user's thumb can be pressed against the thumb-rest portion, when the handle is held in the palm of the user's hand, to grip and tear away packaging after piercing with the pointed end of the blade, and said blade being shorter in length than said handle; and a removable flexible cap that fits over the blade to protect and keep the blade clean, said cap having an inner dimension that fits snugly over the rounded portion of the blade, and said cap having an outer dimension that fits snugly within the interior space of the hollow body.

15. The hand-held tool according to claim 14, further comprising a pair of centering ribs protruding from each of the right and left sides of the hollow body into the interior space for squeezing and holding the cap in place.

16. The hand-held tool according to claim 14, wherein said centering ribs taper in a direction from said bottom side toward said top side so as to form a progressively narrower opening between the centering ribs for squeezing and holding the cap in place.

17. The hand-held tool according to claim 14, further comprising a pair of cross ribs protruding from the top side of the hollow body into the interior space, said cross ribs each providing a fulcrum about which the cap can be pivoted to raise an end thereof to facilitate removal of the cap from the interior space of the hollow body.

18. The hand-held tool according to claim 14, wherein said thumb-rest portion has a shallow depression formed therein for aiding in the removal of pills from a blister-type package.

19. The hand-held tool according to claim 14, wherein said scraping edge comprises a generally straight first portion adjacent to the rounded portion, said first portion extending approximately parallel to a longitudinal axis of the handle, an arcuate second portion adjacent to the first portion, and a generally straight third portion extending between the arcuate second portion and the pointed end.

20. The hand-held tool according to claim 19, wherein said third portion of the scraping edge extends at an obtuse angle relative to said first portion of the scraping edge, and said arcuate second portion of the scraping edge provides a continuous transition from the first portion to the third portion.

21. The hand-held tool according to claim 20, wherein said third portion of the scraping edge is bordered on one side by said thumb-rest portion and on another side by a flat edge which is angled back slightly from perpendicular to the thumb-rest portion.

22. The hand-held tool according to claim 20, wherein a spherical portion is disposed between a front end of the rounded portion and said thumb-rest portion to keep the blade from protruding too far into a package pierced by the blade.

23. The hand-held tool according to claim 14, wherein said handle has a lowered step at the rear end thereof, and a hole extending through said lowered step for hanging the tool.

24. The hand-held tool according to claim 14, wherein said top side has a raised logo area formed thereon for printing visual indicia on said tool.

25. The hand-held tool according to claim 14, wherein said handle and blade are integrally molded from a plastic material.

* * * * *